United States Patent [19]

Bly et al.

[11] Patent Number: 4,724,559

[45] Date of Patent: Feb. 16, 1988

[54] TELESCOPING BED SIDE RAIL

[75] Inventors: Robert R. Bly, Wellington; James T. Spies, Spencer; Bud Spies, West Salem, all of Ohio

[73] Assignee: Invacare Corporation, Elyria, Ohio

[21] Appl. No.: 3,936

[22] Filed: Jan. 16, 1987

[51] Int. Cl.[4] ..... A47C 21/08

[52] U.S. Cl. ..... 5/425; 5/429

[58] Field of Search ..... 5/425–430, 5/100

[56] References Cited

U.S. PATENT DOCUMENTS

| | | | |
|---|---|---|---|
| 2,929,078 | 3/1960 | Smith et al. | 5/428 |
| 2,979,738 | 4/1961 | Goldberg | 5/100 |
| 3,002,200 | 10/1961 | Murcott | 5/331 |
| 3,021,534 | 2/1962 | Hausted | 5/331 |
| 3,032,781 | 5/1962 | Constanti | 5/100 |
| 3,832,428 | 7/1974 | Whyte | 5/429 |
| 4,186,456 | 2/1980 | Huempfner | 5/428 |
| 4,332,042 | 6/1982 | Koncelik | 5/429 |

OTHER PUBLICATIONS

Advertisement of Invacare Corp. for Models 6625 & 6628 Bed Side Rails.

*Primary Examiner*—Gary L. Smith
*Assistant Examiner*—Michael F. Trettel
*Attorney, Agent, or Firm*—Fay, Sharpe, Beall, Fagan, Minnich & McKee

[57] ABSTRACT

A bed rail (A) includes a first vertical end member (10) and a second vertical end member (12) between which cross members (14, 16, 18) and telescopically received stub members (30, 32, 34) extend. The spacer member (B) is connected between free ends of some of the cross members to maintain the positional stability. A pair of brackets (C) slidingly receive the vertical end members. The brackets each includes a slot (64) which is dimensioned with an appropriate width to receive the cross members or the stub members adjacent their interconnection with the end members. A spring biased member (80) is biased by a spring (82) into engagement with a locking aperture (68) in the bracket. A bracket cam surface (66) cams the spring biased member inward as the bed side rail is raised. A knob (84) enables an operator to withdraw the spring biased member to lower the side rail.

21 Claims, 6 Drawing Figures

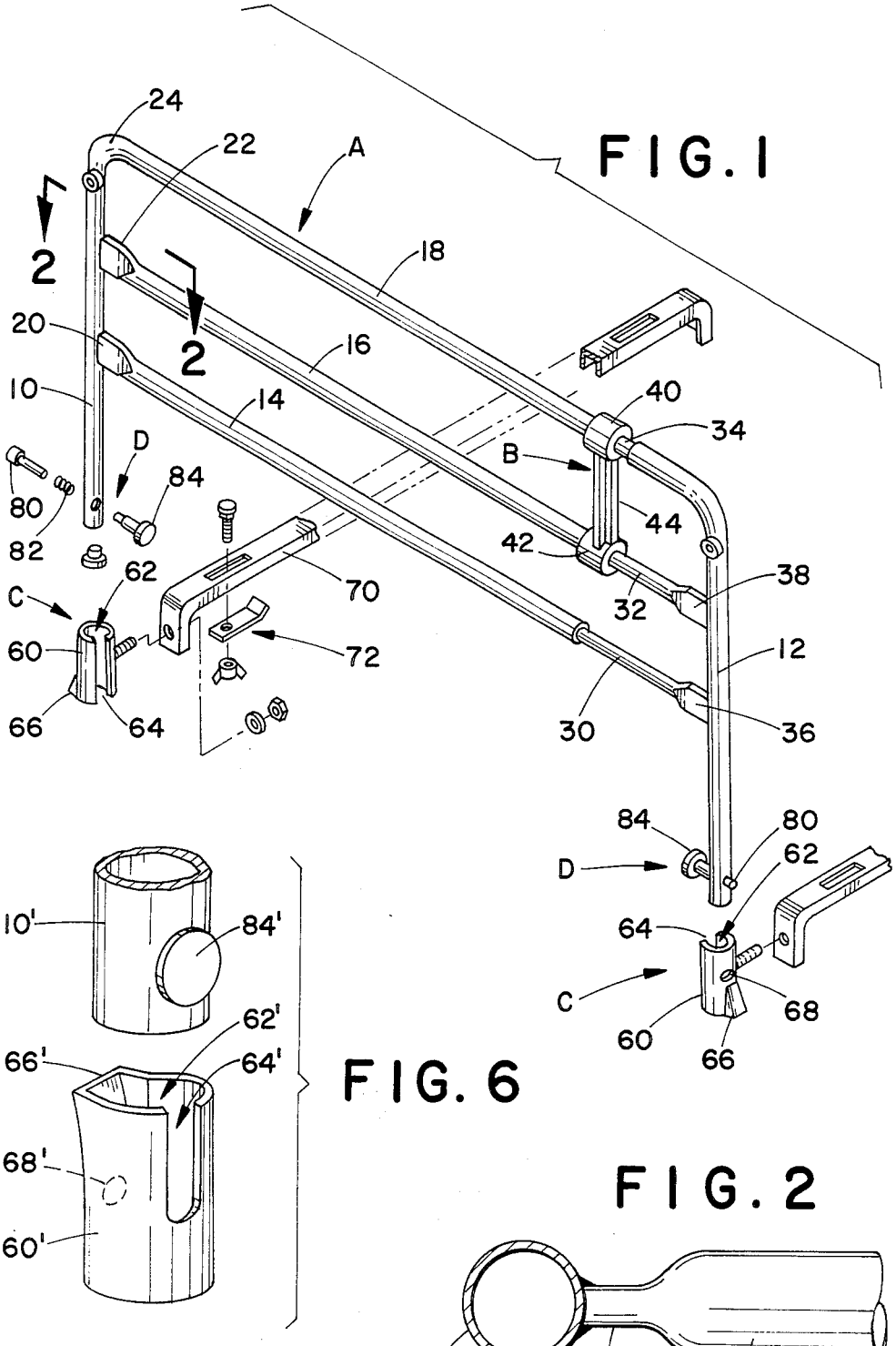
FIG. 1
FIG. 6
FIG. 2
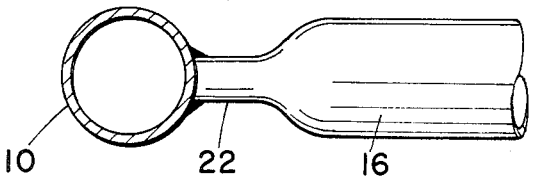

TELESCOPING BED SIDE RAIL

BACKGROUND OF THE INVENTION

The present invention relates to safety devices for beds. The invention finds particular application in conjunction with bed side rails and will be described with particular reference thereto.

Heretofore, beds, such as hospital and invalid care beds, have been provided with side rails. To facilitate entry and egress by a patient, the side rails have commonly been configured to be lowered substantially to the height of the mattress or below. After the patient was in the bed, the side rails were raised and locked in the raised position. Various mounting assemblies have been provided to enable the guard rail to be raised and lowered.

Commonly, the bed side rails included a plurality of parallel cross members or rails which were interconnected between generally vertical end members. The end members were slidably received in tubular mounting brackets on the bed. Various techniques have been utilized to avoid interference between the tubular mounting brackets and the horizontal cross rails. In one prior art bed rail, the lower cross rails were bent upward to connect adjacent the top of the vertical side rails. The top connection provided a long, uninterrupted length for sliding receipt in the bracket. In another bed side rail, the vertical end members were generally U-shaped tubes. A first leg of each U-shaped end member was connected with the horizontal cross rails and a second leg was slidably received in the bracket. In this manner, the second leg provided a relatively long, uninterrupted sliding length.

One drawback of both of these prior art designs concerned patient safety. When the cross member bent upward toward the top of the vertical member, a pocket was defined. A patient's limb or hospital care equipment could become trapped in the pocket as the bed rail was lowered. The generally U-shaped end members of the other bed rail also formed a pocket in which a patient's limb or invalid care equipment could become caught as the rail was lowered.

Another drawback to the prior art designs resided in relatively high manufacturing cost. Bending either the cross rails or the end rails increased labor costs, hence, the cost of the end product.

In accordance with the present invention, a new and improved bed rail construction is provided.

SUMMARY OF THE INVENTION

In accordance with one aspect of the present invention at least one mounting bracket is operatively connected with a bed. The bracket defines a generally vertical slide passage therethrough and a generally vertical slot between the slide passage and an exterior of the bracket. A generally vertical side rail end member is slidably received in the bracket slide passage. The generally horizontally disposed cross rail is connected with the generally vertical end member. At least one cross rail is dimensioned at the interconnection to the vertical end member to pass through the bracket slot during sliding movement of the first side rail end member. A locking means selectively fixes the generally vertical end member against sliding movement in the slide passage. In this manner, the bed side guard is selectively movable between raised and lowered positions.

In accordance with another aspect of the present invention, a bed side guard and a pair of mounting brackets therefor are provided. Each mounting bracket has a generally vertical slide passage extending therethrough. At least one of the mounting brackets includes a locking aperture and a slot between the slide passage and an exterior of the bracket. Each bed side guard has a pair of vertical end members with a plurality of cross members extending therebetween. At least one of the vertical end members has a spring biased member mounted adjacent a lower end thereof. The spring biased member is spring biased to project from the end member lower end for selective receipt in the bracket locking aperture. A manually graspable handle is operatively connected with the spring biased member for selectively withdrawing the spring biased member from the locking aperture. The handle is dimensioned and interconnected for sliding receipt in the slot. The bracket further includes a cam surface in vertical alignment with the locking aperture for camming the spring biased member against its spring bias and as the guard rail is raised. In this manner, as the guard rail is raised, the cam surface urges the spring biased member to retract; with continued raising of the guard rail, the spring biased member becomes aligned with the locking aperture and is spring biased into engagement therewith.

In accordance with another aspect of the present invention, a telescopically extendable bed side guard assembly is provided. A pair of brackets are selectively mountable to a bed. First and second generally vertical end members are mounted in a sliding relationship with the first and second brackets, respectively. The first end member includes at least first and second horizontal cross members connected thereto. First and second stub members are connected with the second end member to extend generally horizontally therefrom. The first and second cross members telescopically engage the first and second stub members, respectively, such that the first and second end members can be moved together or apart by increasing the degree of telescopic receipt between the cross and stub members. A spacer member is connected between the first and second cross members adjacent free ends thereof to maintain the first and second cross members in a parallel relationship.

One advantage of the present invention is that it improves the safety of bed side rails.

Another advantage of the present invention is that it expedites manufacture and reduces manufacturing costs.

Yet another advantage of the present invention is that improves durability and extends product life.

Still further advantages of the present invention will become apparent upon reading and understanding the following detailed description of the preferred embodiments.

BRIEF DESCRIPTION OF THE DRAWINGS

The invention may take form in various parts and arrangements of parts. The drawings are only for purposes of illustrating a preferred embodiment and are not to be construed as limiting the invention.

FIG. 1 is a partially exploded view of a bed side guard assembly in accordance with the present invention;

FIG. 2 is a view in partial section to section 2—2 of FIG. 1;

DETAILED DESCRIPTION OF THE PREFERRED EMBODIMENT

Figure 3:
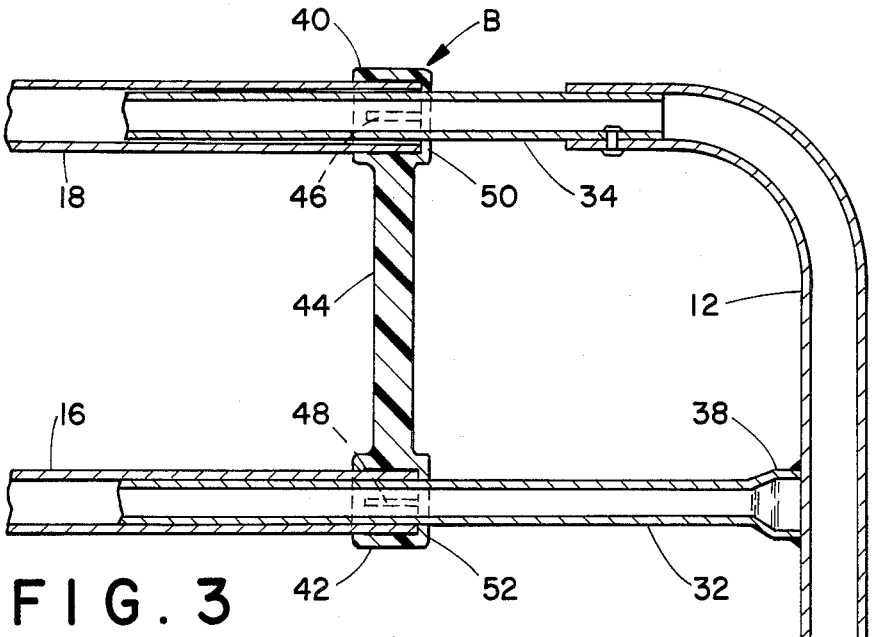
FIG. 3 is a sectional view illustrating telescopic expansion and contraction of the bed side guard assembly and a cross brace spacer member.

With reference to FIG. 1, the bed side guard assembly includes a telescopically elongatable bed rail A for selectively retaining a patient in bed. A spacer means B maintains cross members of the side frame in a preselected, preferably parallel, horizontal relationship. The bed rail is slidably mounted in a pair of brackets C which are pivotally mounted to a bed. In a hospital bed in which portions of the bed frame are movable to raise and lower the patient's head, feet, or the like, the brackets are preferably mounted to the movable frame portions such that the bed rail moves with the patient. Telescopic elongation/contraction of the bed rail compensates for changes in the effective spacing of the brackets as bed portions are raised and lowered. The bed rail is movable in the brackets at least between a lowered position and a raised position in which the bed rail is locked by a locking means D.

The side rail A includes a first vertical side rail end member 10 and a second vertically disposed end member 12. A plurality of cross members 14, 16, 18 are connected with the first end member and extend therefrom in a horizontal, parallel relationship. The first and second cross members 14, 16 have reduced width portions 20, 22 adjacent the interconnection with the first end member. The third cross member 18 is integrally connected with the first end member by a bend 24. A plurality of stub members 30, 32, and 34 are connected with the second end member and extend therefrom in a horizontal, parallel relationship. The first and second stub member 30, 32 have reduced width of portions 36, 38 adjacent their respective interconnections with the second end member 12. The stub members and cross members are dimensioned for telescopic interengagement such that the distance between the vertical end members, hence the length of the bed rail, is selectively adjustable. The telescopic, sliding length adjustment enables the length of the bed rail to adjust as portions of the bed frame to which it is mounted are moved.

With reference to FIG. 3 and continuing reference to FIG. 1, the spacer means B defines a first socket 40 and a second socket 42 interconnecting a spacer portion or member 44. The first socket 40 has internal friction ribs or other reduced cross sections 46 to receive a free end of the top cross rail 18 in tight frictonal engagement. The second socket 42 has inward projecting ribs 48 to receive a free end of the second cross rail 16 in tight frictional engagement. The spacer portion 44 fixes the spacing between the frist and second sockets such that the free ends of the cross members are held in the parallel relationship. The first and second sockets have contracted diameter portions 50, 52 which extend around the free end of the cross members and define guide surfaces for sliding receipt of the second and third stub members 32, 34.

Figure 4:
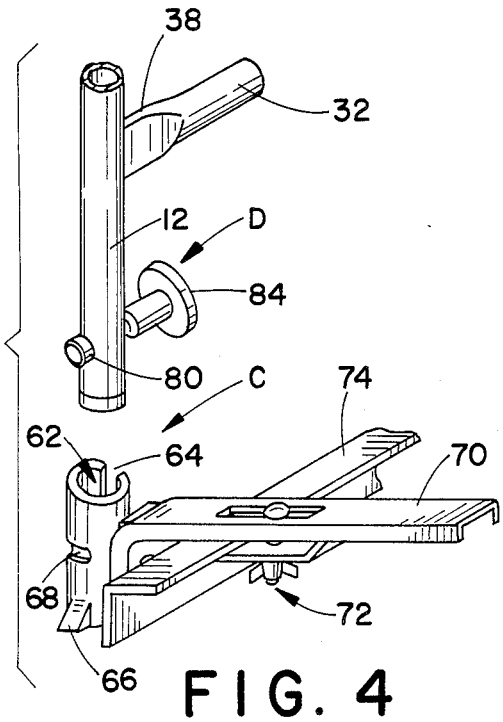
FIG. 4 is an enlargement of a mounting bracket of the assembly of FIG. 1 from the opposite side of the mounting bracket clamped to a bed frame.
Figure 5:
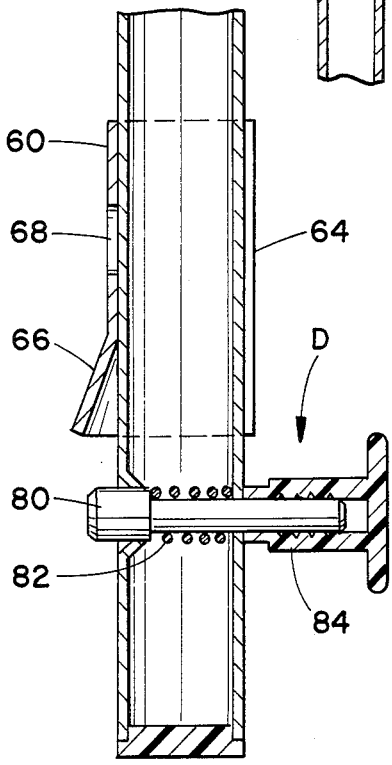
FIG. 5 is a side sectional view of the mounting bracket and a locking pin assembly mounted in a bed side frame end member; and, FIG. 6 is a perspective view of an alternate embodiment of the present invention.

With continuing reference to FIG. 1 and further reference to FIGS. 4 and 5, the brackets C are each of analogous construction. Accordingly, each bracket will be described with the same reference numerals. Each bracket includes a generally C-shaped cross section sleeve 60 which defines a slide passage 62 therethrough. A lower end of one of the vertical end members 10, 12 is slidably received in the slide passage. A vertical slot 64 extends between the slide passage 62 and an exterior of the sleeve 60. The slot 64 is dimensioned with an appropriate width to receive the reduced width end portions 20, 22 and 36, 38 of the cross members 14, 16 or the stubs 30, 32. Diametrically opposite from the slot, in the preferred embodiment, the bracket defines a cam surface 66 and a locking aperture 68. The bracket is mounted to a rail 70 which is clamped by a clamp assembly 72 to a frame portion 74 of the bed.

With continuing reference to FIGS. 1, 4 and 5, the locking means D may include a single locking means in conjunction with one of the vertical end members or like locking means for each end assembly. In the preferred embodiment, like locking means are provided for each end. To facilitate description of the preferred embodiment, only a single one of the two like locking means will be described in detail and it will be appreciated that the description applies to both. Each locking means includes a spring biased member 80 which is spring biased to project from a lower end of one of the vertical end members 10, 12 by a spring 82. A handle member 84 is adapted to be grasped manually to retract the spring biased member 80. In the preferred embodiment, the handle member 84 is mounted to the end member in vertical alignment with the reduced width connecting portions 20, 22; 36, 38 of the cross members or stubs such that the handle portion slides through the slot 64. This enables the bed rail to be withdrawn completely from the bracket. Optionally, if the bed rail A is to be blocked from being removed from the bracket, the handle 84 may be offset from the slot or may be received in another slot extending only part way through the bracket sleeve. The spring biased member 80 projects from the end member in vertical alignment with the bracket cam surface 66 and the aperture 68. In this manner, as the end rail is raised the cam surface 66 cams the spring biased member generally flush with the end member until it becomes aligned with the aperture 68. The spring 82 then biases the spring biased member 80 into the locking aperture 68 to lock the side rail in its raised position. Optionally, a longer bracket with multiple apertures or multiple locking assemblies may be provided along each end member to provide a plurality of positions in which the bed rail may be locked.

In the embodiments of FIG. 6, like elements with the embodiment of FIGS. 1–5 are marked with like reference numerals but followed by a prime (′). A sleeve 60′ defines a tubular member receiving passage 62′ therein. A slot 64′ between the slide passage and an exterior of the sleeve extends part way therealong to limit the receipt of the tubular member 10′ by engaging a handle member 84′. A cam surface 66′ cams a spring biased member (not shown) inward to facilitate receipt of the tubular member and associated elements of a locking means D. The spring biased element is spring biased into engagement with an aperture 68′ aligned with the cam surface. To remove the tubular member, the handle member is manually engaged to withdraw the spring biased member from the aperture.

The invention has been described with reference to the preferred embodiment. Obviously, modifications and alterations will occur to others upon reading and understanding the preceding specifications. It is intended that the invention be construed as including all such alterations and modifications insofar as they come within the scope of the appended claims or the equivalents thereof.

Having thus described the preferred embodiment, the invention is now claimed to be:

1. A bed side guard assembly comprising:
a first mounting bracket operatively connected with a bed, the first bracket defining a first generally vertical slide passage therethrough and a first generally vertical slot between the first slide passage and an exterior of the first bracket;
a first generally vertically disposed side rail end member slidably received in the first bracket slide passage;
a first generally horizontal disposed cross member connected at one end with the first end member, the first cross member being dimensioned at the one end to pass through the first bracket slot during sliding movement of the first end member in the first bracket slide passage; and,
a first locking means for selectively fixing the first end member against sliding movement in the first slide passage, the first locking means being operatively connected with the first bracket and the first end member.

2. The bed side guard assembly as set forth in claim 1 further including a second generally vertical end member operatively connected with the first cross member and a second bracket which defines a second slide passage therethrough, the second end member being slidably received in the second bracket slide passage.

3. The bed side guard assembly as set forth in claim 2 further including a second cross rail operatively connected with the first and second end members.

4. The bed side guard assembly as set forth in claim 3 further including a spacer member connected between the cross rails for maintaining a parallel relationship therebetween.

5. The bed side guard assembly as set forth in claim 1 wherein the locking means includes a spring biased member which is mounted to the first end member and spring biased to project therefrom for selective receipt in a locking aperture defined in the first bracket.

6. The bed side guard assembly as set forth in claim 5 wherein the bracket defines a cam surface for camming the spring biased member against its spring bias during sliding movement of the first end member in the slide passage.

7. The bed side guard assembly as set forth in claim 5 further including a manually graspable knob connected to the spring biased member for manually retracting the spring biased member against its spring bias, the knob being mounted to pass through the bracket slot during sliding movement of the first end member.

8. The bed side guard assembly as set forth in claim 1 further including:
a second horizontal cross member disposed parallel to the first guard rail;
a second mounting bracket defining a second generally vertical slide passage therethrough, the second bracket being connected with the bed;
a second side rail end member slidably received in the second bracket slide passage; and,
first and second horizontal stub members connected with the second end member and telescopically connected with the first and second horizontal cross members, whereby a dimension between the first and second side rail end members is selectively adjustable.

9. The bed side guard assembly as set forth in claim 8 further including a spacer member operatively connected with the first and second cross members to maintain a horizontal relationship therebetween.

10. The bed side guard assembly as set forth in claim 9 wherein the first and second cross members define interior passages therein for slidably receiving the first and second stub members, respectively, and wherein the spaer member is connected with the first and second cross members adjacent free ends thereof and defines friction slide surfaces for the first and second stub members.

11. The bed side guard assembly as set forth in claim 8 wherein the second bracket further defines a second generally vertical slot between the second slide passage and an exterior of the second bracket, the stub members being dimensioned adjacent the second end member to pass through the second slot.

12. A mounting assembly comprising:
a mounting bracket defining a generally vertical slide passage therein and a generally vertical slot between the first slide passage and an exterior of the first bracket;
a generally vertically disposed rod member slidably received in the bracket slide passage;
a locking means for selectively fixing the rod member against sliding removal from the slide passage, the locking means including:
a spring biased member which is mounted on the rod member and spring biased to project therefrom;
a cam surface on the mounting bracket to cam the spring biased member against the spring bias as the rod member is received in the slide passage;
an aperture defined in the mounting bracket in alignment with the cam surface into which the spring biased member is spring biased; and
a knob connected to the spring biased member for retracting the spring biased member against the spring bias, the knob projecting from the rod member and being disposed for receipt in the slot as the rod member is received in the slide passage.

13. A bed side guard assembly comprising:
first and second brackets operatively connectable with a bed;
a bed rail including:
first and second end members disposed in a sliding relationship with the first and second brackets, such that the first and second end members are slidably movable relative to the first and second brackets;
a first cross member connected at one end with the first end members;
a first stub member connected with the second end member and received within a terminal end of the first cross member in a telescopic, sliding relationship;
a second cross member connected at one end with the first end member;
a second stub member connected at one end with the second end member and received within an internal passage at a terminal end of the second cross member in a telescopic, sliding relationship;

a spacer member including a first socket portion which receives and extends around the terminal end of the first cross member and provides a bearing surface for the sliding telescopic receipt of the first stub member, a second socket portion which receives and extends around the terminal end of the second cross member and provides a bearing surface for the sliding telescopic receipt of the second stub member, and a spacer portion connected between the first and second socket portions for maintaining the first and second cross members in a preselected relationship.

14. The bed side guard assembly as set forth in claim 13 wherein the first and second brackets define first and second slide passages, respectively, the first and second end members being slidably received in the first and second slide passages, respectively; and, the first and second brackets further defining first and second slots between the first and second slide passages, respectively, and exteriors of the brackets, the first and second cross members being dimensioned adjacent their connection with the first end member to pass through the first slot and the first and second stub members being dimensioned adjacent their connection with the second end member to pass through the second slot.

15. The bed side guard assembly as set forth in claim 13 wherein at least one of the end members has a spring biased projection which is spring biased to project therefrom and wherein the corresponding bracket has a cammed surface for camming the projection against the spring bias and a locking aperture for receiving the spring biased member for locking the relative, vertical position of the bracket and end member.

16. A bed side guard assembly comprising:

a side rail including first and second end members and a plurality of cross members extending therebetween;

a bracket operatively connectable to a bed, the bracket defining a slide passage therethrough and a slot extending between the slide passage and an exterior of the bracket, the first end member being slidably received in the slide passage, the bracket further defining a locking aperture therethrough transverse to the slide passage;

a spring biased member mounted transversely through the first end member and spring biased to extend longitudinally outward therefrom for receipt in the locking aperture, the spring biased member being manually retractable longitudinally into the first end member to remove the spring biased member from the locking aperture to move the side rail.

17. The bed side guard assembly as set forth in claim 16 wherein the bracket includes a cam surface disposed below and in vertical alignment with the locking aperture for camming the spring biased member into the first end member as the side rail is moved.

18. A bed side guard assembly comprising:

a side rail including first and second end members and a plurality of cross members extending therebetween;

a first bracket operatively connectable to a bed, the first bracket defining a first slide passage therethrough into which the first end member is slidably received and a first slot extending between the first slot passage and an exterior of the first bracket, the first slot being dimensioned such that the cross members pass slidingly therethrough;

a second bracket operatively connectable to the bed, the second bracket defining a second slide passage therethrough in which the second end member is slidably received; and, a second slot extending between the second slide passage and an exterior of the second bracket wherein the second slot being dimensioned such that the cross members pass slidingly therethrough.

19. The bed side guard assembly as set forth in claim 18 further including:

first and second stub members which interconnect the first and second cross members with the second end member, the first and second stub members being slidably received in a telescopic relationship with the first and second cross members; and, a spacer member disposed between the first and second cross members to maintain a preselected spaced relationship therebetween.

20. A bed side guard assembly comprising:

a side rail including first and second end members and cross members extending therebetween;

a first bracket operatively connectable to a bed, the first bracket defining a first slide passage therethrough and a first slot extending between the first slot passage and an exterior of the first bracket, the first end member being slidably received in the first slide passage, the first bracket further defining a first locking aperture therethrough;

a first spring biased member mounted in the first end member and spring biased to project outward therefrom and into receipt in the first locking aperture;

a first handle means extending from the first spring biased member through the first slot for facilitating manual retraction of the first spring biased member from the first locking aperture.

21. The bed side guard assembly as set forth in claim 20 further including a second bracket which defines a second slot extending between a second slide passage and an exterior of the second bracket, the second bracket further defining a second locking aperture therethrough and further including a second spring biased member mounted in the second end member and spring biased to project outward therefrom and into receipt in the second locking aperture, a second handle means which extends from the second spring biased member through the second slot facilitates manual retraction of the second spring biased member from the second locking aperture to lower the side rail.

* * * * *